US010191399B2

(12) United States Patent
Mizutani et al.

(10) Patent No.: US 10,191,399 B2
(45) Date of Patent: Jan. 29, 2019

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Noriyuki Mizutani, Kanagawa (JP); Kotaro Yoshihara, Kanagawa (JP); Erina Saito, Kanagawa (JP); Narumasa Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/130,062

(22) Filed: Apr. 15, 2016

(65) Prior Publication Data

US 2017/0184988 A1 Jun. 29, 2017

(30) Foreign Application Priority Data

Dec. 28, 2015 (JP) ..... 2015-256940

(51) Int. Cl.
*G03G 9/09* (2006.01)
*G03G 9/087* (2006.01)

(52) U.S. Cl.
CPC ..... *G03G 9/08755* (2013.01); *G03G 9/08795* (2013.01); *G03G 9/08797* (2013.01); *G03G 9/09* (2013.01)

(58) Field of Classification Search
CPC ..... G03G 9/09
See application file for complete search history.

(56) References Cited

U.S. PATENT DOCUMENTS 3,590,000 A * 6/1971 Palermiti ..... G03G 9/08755 430/108.3
6,071,665 A * 6/2000 Dickerson ..... G03G 9/081 430/137.21
2008/0181647 A1* 7/2008 Tomizawa ..... G03G 9/0821 399/74
2011/0305986 A1* 12/2011 Ogawa ..... G03G 9/0804 430/108.4
2011/0311909 A1* 12/2011 Vanbesien ..... G03G 9/0804 430/108.1
2012/0082829 A1* 4/2012 Iio ..... G03G 8/00 428/203

(Continued)

FOREIGN PATENT DOCUMENTS

JP 2007-323025 A 12/2007
JP 2010-079084 A 4/2010

(Continued)

*Primary Examiner* — Peter L Vajda
(74) *Attorney, Agent, or Firm* — Oliff PLC

(57) ABSTRACT

An electrostatic charge image developing toner includes first toner particles containing a binder resin and a colorant and second toner particles containing a binder resin and containing or not containing a colorant, wherein a content PCa of the colorant contained in the first toner particles is from 4% by weight to 20% by weight with respect to the first toner particles, a content PCb of the colorant contained in the second toner particles is from 0% by weight to 2% by weight with respect to the second toner particles, and a weight ratio of the first toner particles and the second toner particles (weight of the first toner particles/weight of the second toner particles) is from 50/50 to 98/2.

9 Claims, 2 Drawing Sheets

(56) References Cited

U.S. PATENT DOCUMENTS

| | | | | |
|---|---|---|---|---|
| 2012/0251169 | A1 | 10/2012 | Aoki et al. | |
| 2013/0252164 | A1* | 9/2013 | Iida | G03G 9/09716 430/108.11 |
| 2014/0288262 | A1* | 9/2014 | Yamato | G03G 9/08755 528/304 |
| 2015/0093697 | A1* | 4/2015 | Hashimoto | G03G 9/08755 430/105 |

FOREIGN PATENT DOCUMENTS

| | | | |
|---|---|---|---|
| JP | 2012-189771 | A | 10/2012 |
| JP | 2012-215739 | A | 11/2012 |

* cited by examiner

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-256940 filed Dec. 28, 2015.

BACKGROUND

1. Technical Field

The present invention relates to an electrostatic charge image developing toner, an electrostatic charge image developer, and a toner cartridge.

2. Related Art

A method of visualizing image information through an electrostatic charge image, such as electrophotography, is currently used in various fields. In electrophotography, the image information is formed on a surface of an image holding member (for example, a photoreceptor) as an electrostatic charge image, a toner image is developed on the surface of the image holding member using a developer containing a toner, and this toner image is visualized as an image through a transfer process of transferring the toner image to a recording medium such as a sheet and a fixing process of fixing the toner image onto a surface of the recording medium.

SUMMARY

According to an aspect of the invention, there is provided an electrostatic charge image developing toner including:

first toner particles containing a binder resin and a colorant, and second toner particles containing a binder resin and containing or not containing a colorant, wherein a content PCa of the colorant contained in the first toner particles is from 4% by weight to 20% by weight with respect to the first toner particles, a content PCb of the colorant contained in the second toner particles is from 0% by weight to 2% by weight with respect to the second toner particles, and a weight ratio of the first toner particles and the second toner particles (weight of the first toner particles/weight of the second toner particles) is from 50/50 to 98/2.

BRIEF DESCRIPTION OF THE DRAWINGS

Exemplary embodiments of the present invention will be described in detail based on the following figures, wherein.

DETAILED DESCRIPTION

Figure 1:
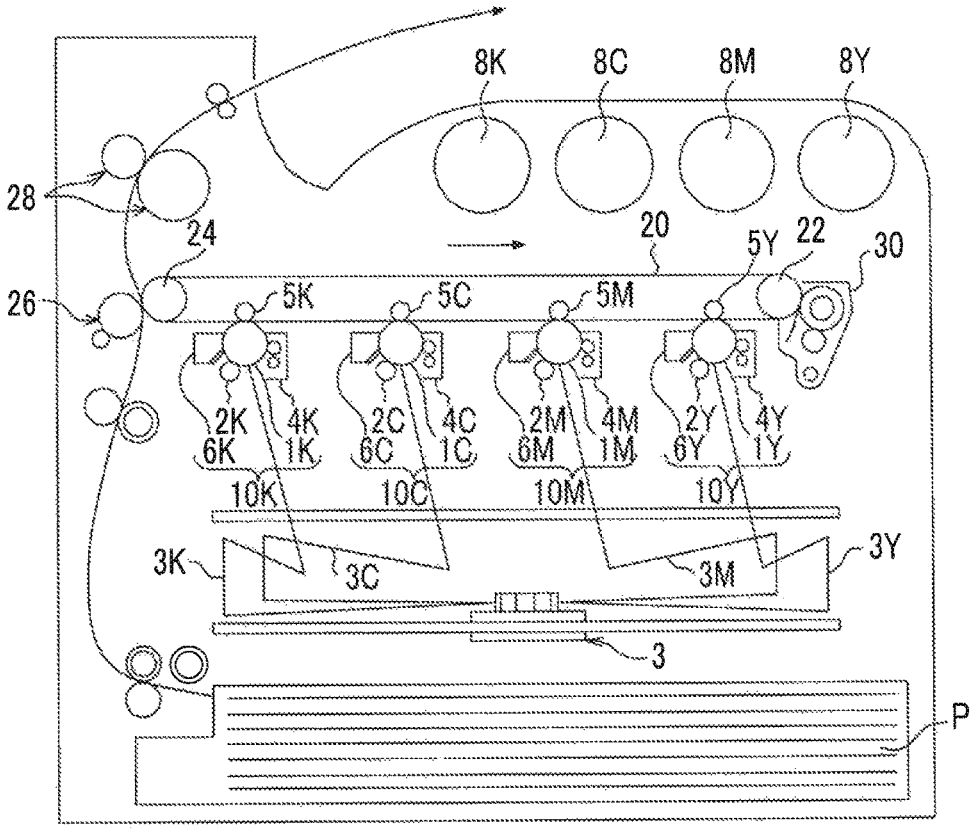
FIG. 1 is a schematic configuration diagram showing an example of an image forming apparatus according to the exemplary embodiment.

Hereinafter, exemplary embodiments which are examples of the invention will be described. The embodiments are examples of the invention and do not limit the scope of the invention.

Electrostatic Charge Image Developing Toner

An electrostatic charge image developing toner according to the exemplary embodiment (hereinafter, referred to as a "toner") includes first toner particles (hereinafter, referred to as "colored toner particles" for convenience)" containing a binder resin and a colorant, and second toner particles (hereinafter, referred to as "transparent toner particles" for convenience)" containing a binder resin and containing or not containing a colorant.

The content PCa of the colorant of the colored toner particles is from 4% by weight to 20% by weight with respect to the colored toner particles. The content PCb of the colorant of the transparent toner particles is from 0% by weight to 2% by weight with respect to the transparent toner particles. A weight ratio of the colored toner particles and the transparent toner particles (weight of the colored toner particles/weight of the transparent toner particles) is from 50/50 to 98/2.

With the configuration described above, the toner according to the exemplary embodiment prevents a decrease in resolution of a fine image, when a fine image is formed on a recording medium having great surface ruggedness. The reason thereof is assumed as follows.

First, when a fine image such as a readable image (a barcode, a quick response (QR) code, or an augmented reality (AR) marker) or a small character is formed on a recording medium having great surface ruggedness (rough paper or the like), the resolution may be decreased. It is considered that the decrease in resolution of a fine image is due to occurrence of scattering of the toner or defects of the toner image when transferring or fixing the toner image to cause occurrence of loss of definition or thickening of a line image configuring the readable image or the small character, when the recording medium has great surface ruggedness.

Specifically, when transferring and fixing the toner image, the toner in the toner image which is originally aligned on an image holding member is scattered around the image due to an effect of the surface ruggedness of the recording medium. When the toner scattered around the line image is fixed, the scattered toner is recognized as a line width of the line image. In addition, when line images are adjacent to each other and the ranges of the scattering of the toner are overlapped with each other, the line images are recognized as one line image having a great line width.

Accordingly, it is considered that, when a fine image such as a readable image or a small character is formed on a recording medium having great surface ruggedness, the resolution is decreased due to loss of definition or thickening of line images. When the resolution of the fine image is decreased, accuracy of reading is decreased in a case of the readable image, and character recognition is decreased in a case of the small character.

Therefore, the toner is allowed to contain the colored toner particles and the transparent toner particles and the content of the colorant in the colored toner particles and the transparent toner particles and the weight ratio of the colored toner particles and the transparent toner particles are set to be in the range described above (hereinafter, this toner is also referred to as a "mixed toner" for convenience).

When a fine image such as a readable image or a small character is formed on a recording medium having great surface ruggedness with this mixed toner, a fixed portion of the colored toner is recognized but a fixed portion of the transparent toner is hardly recognized, among the ranges where the toner is scattered around the line image. That is, in a portion where the toner is scattered in the fixed line image, that is, a portion in the outer side of an original image portion, the fixed portion of the colored toner is divided due to the fixed portion of the transparent toner which is hardly recognized, and the fixed portion of the colored toner is hardly recognized or recognized as dots, and accordingly, the entire fixed portion thereof is hardly recognized as an image. Therefore, the scattering thereof is hardly recognized as loss of definition or thickening of a line image and a decrease in resolution of a fine image is prevented.

As described above, it is assumed that the toner according to the exemplary embodiment prevents a decrease in resolution of a fine image, with the configuration described above, when a fine image is formed on a recording medium having great surface ruggedness.

Specifically, when a readable image (a barcode, a quick response (QR) code, or an augmented reality (AR) marker) is formed on a recording medium having great surface ruggedness, the toner according to the exemplary embodiment prevents a decrease in accuracy of reading of the readable image. In addition, when a small character is formed, the toner also prevents a decrease in accuracy of reading of the small character.

Particularly, a decrease in resolution of a fine image remarkably occurs when forming a fine image having a secondary or tertiary color which causes a large amount of toner to be scattered, due to a large amount of the toner to be transferred or fixed. However, the toner according to the exemplary embodiment prevents a decrease in resolution of the fine image, when the fine image having a secondary or tertiary color is formed on a recording medium having great surface ruggedness.

Herein, as a recording medium having great surface ruggedness, a recording medium having a Bekk smoothness equal to or less than 50 seconds (for example, rough paper) is used. The Bekk smoothness is a value measured based on a method of JIS P 8119 (1998).

Hereinafter, the toner according to the exemplary embodiment will be described in detail.

The toner according to the exemplary embodiment includes toner particles. The toner may include an external additive.

Toner Particles

The toner particles include colored toner particles (first toner particles) containing a binder resin and a colorant, and transparent toner particles (second toner particles) containing a binder resin and containing or not containing a colorant.

The colored toner particles are toner particles in which the content PCa of the colorant is from 4% by weight to 20% by weight with respect to the colored toner particles and which represents black, cyan, magenta, or yellow, for example.

When the content PCa of the colorant is set to be equal to or greater than 4% by weight, a decrease in image density of the fine image is prevented. Meanwhile, when the content PCa of the colorant is set to be equal to or smaller than 20% by weight, excessive coloring of the fixed portion of the colored toner scattered around the line image is prevented and occurrence of loss of definition or thickening of the line image is prevented. As a result, a decrease in resolution of the fine image is prevented. It is also easy to ensure image density of the fine image. In addition, it is also easy to prevent an excessive increase or decrease in image density, when a solid image is formed.

From the viewpoints described above, the content PCa of the colorant is preferably from 5% by weight to 18% by weight and more preferably from 5% by weight to 15% by weight.

The transparent toner particles are toner particles in which the content PCb of the colorant is from 0% by weight to 2% by weight with respect to the transparent toner particles and which represents transparent or light color, for example.

In a case where the transparent toner particles contain a colorant and the content PCb of the colorant is set to be equal to or smaller than 2% by weight, excessive coloring of the fixed portion of the transparent toner scattered around the line image is prevented, a dividing function on the fixed portion of the colored toner is exhibited, and occurrence of loss of definition or thickening of the line image is prevented. As a result, a decrease in resolution of the fine image is prevented. It is also easy to ensure image density of the fine image. In addition, it is also easy to prevent an excessive increase or decrease in image density, when a solid image is formed.

From the viewpoints described above, the content PCb of the colorant is preferably from 0% by weight to 1% by weight and more preferably 0% by weight (that is, no colorant is contained).

The total content of the colorant of the colored toner particles and the colorant of the transparent toner particles (content PCa+content PCb) is preferably from 4% by weight to 15% by weight, more preferably from 5% by weight to 15% by weight, and even more preferably from 5% by weight to 12% by weight, with respect to the total amount of the first toner particles and the second toner particles, from viewpoints of prevention of a decrease in resolution of the fine image and ensuring suitable image density of the fine image and the solid image.

The weight ratio of the colored toner particles and the transparent toner particles (weight of the colored toner particles/weight of the transparent toner particles) is from 50/50 to 98/2 and the transparent toner particles are set to be equal to or smaller than the half of the entirety of the toner particles.

When the weight ratio is set to be equal to or greater than 50/50, the division of the line image due to the fixed portion of the excessive transparent toner is prevented and a break of the line image is prevented. Meanwhile, when the weight ratio is equal to or smaller than 98/2, the dividing function on the fixed portion of the colored toner is exhibited by the fixed portion of the transparent toner scattered around the line image and occurrence of loss of definition or thickening of the line image is prevented. As a result, a decrease in resolution of the fine image is prevented. It is also easy to ensure image density of the fine image. In addition, it is also easy to prevent an excessive increase or decrease in image density, when a solid image is formed.

From the viewpoints described above, the weight ratio is preferably from 50/50 to 95/5 and more preferably from 50/50 to 90/10.

Herein, in the measurement of the content of the colorant of the colored toner particles and the transparent toner particles and the weight ratio of the colored toner particles and the transparent toner particles, the toner to be measured is spread on slide glass and set as a toner layer on which the toner particles are not overlapped. Then, the measurement is performed by observing the toner layer with an optical microscope (transmitted light) or performing image analysis of coloring concentration of each toner particle.

Specifically, the weight ratio of the colored toner particles and the transparent toner particles may be measured by the following method. That is, an image observed with an optical microscope (transmitted light) is input to an image analyzer (LUZEX III: manufactured by NIRECO), the toner particles are divided into the colored toner particles and the transparent toner particles by performing binarization with concentration of respective particles, and the ratio of the colored toner particles and the transparent toner particles may be determined by counting the number thereof.

In addition, the content of the colorant of the colored toner particles and the transparent toner particles may be calculated from the weight ratio of the colored toner and the transparent toner, a concentration ratio of the colored toner and the transparent toner in the image analysis, and the amount of the colorant contained in the entire mixed toner. Since the content of the colorant and the concentration obtained by observation with an optical microscope are in proportion to each other, a concentration ratio A of the colored toner and the transparent toner in the image analysis becomes a rate of the amount of the colorant contained. In addition, in a case of a cyan toner, for example, the amount of colorant B [%] contained in the entire mixed toner may be determined by measuring the amount of copper of a cyan pigment contained in the mixed toner by a fluorescence X-ray device.

Specifically, when a colored toner rate is set as $\alpha$ [%] and a transparent toner rate is set as $100-\alpha$ [%], the concentration ratio A of the colored toner and the transparent toner and the amount of colorant B [%] contained in the entire mixed toner may be calculated by the following expression.

Expression: $A=PCa/PCb$

Expression: $B=PCa\times\alpha/100+PCb\times(100-\alpha)/100$

The content PCa/PCb of the colorant of the colored toner particles and the transparent toner particles may be calculated by the following expression using the calculated A and B.

Expression: $PCa=100\times A\times B/\{(A-1)\alpha+100\}$

Expression: $PCb=100B/\{(A-1)\alpha+100\}$

Next, each component of the toner particles (colored toner particles and transparent toner particles) will be described.

The toner particles contain a binder resin and a colorant in both of the colored toner particles and the transparent toner particles. Herein, the transparent toner particles may not contain a colorant. The toner particles may contain a release agent and other additives, in addition to a binder resin and a colorant.

Binder Resin

Examples of the binder resin include vinyl resins formed of homopolymers of monomers such as styrenes (for example, styrene, parachlorostyrene, and $\alpha$-methylstyrene), (meth)acrylates (for example, methyl acrylate, ethyl acrylate, n-propyl acrylate, n-butyl acrylate, lauryl acrylate, 2-ethylhexyl acrylate, methyl methacrylate, ethyl methacrylate, n-propylmethacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (for example, vinyl methyl ketone, vinyl ethyl ketone, and vinyl isopropenyl ketone), and olefins (for example, ethylene, propylene, and butadiene), or copolymers obtained by combining two or more kinds of these monomers.

Examples of the binder resin also include a non-vinyl resin such as an epoxy resin, a polyester resin, a polyurethane resin, a polyamide resin, a cellulose resin, a polyether resin, and modified rosin, mixtures thereof with the above-described vinyl resin, or graft polymer obtained by polymerizing a vinyl monomer with the coexistence of such non-vinyl resins.

These binder resins may be used alone or in combination of two or more kinds thereof.

In addition, the binder resins of the colored toner and the transparent toner may be the same kind or different kind from each other. The same binder resin is preferably used.

As the binder resin, a polyester resin is suitable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with a diol. Examples of the tri- or higher-valent polyol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is determined by a DSC curve obtained by differential scanning calorimetry (DSC), and more specifically, is determined by "Extrapolated Glass Transition Starting Temperature" disclosed in a method of determining a glass transition temperature of JIS K 7121-1987 "Testing Methods for Transition Temperatures of Plastics".

The weight average molecular weight (Mw) of the polyester resin is preferably from 5,000 to 1,000,000 and more preferably from 7,000 to 500,000.

The number average molecular weight (Mn) of the polyester resin is preferably from 2,000 to 100,000.

The molecular weight distribution Mw/Mn of the polyester resin is preferably from 1.5 to 100 and more preferably from 2 to 60.

The weight average molecular weight and the number average molecular weight are measured by gel permeation chromatography (GPC). The molecular weight measurement by GPC is performed by using HLC-8120, GPC manufactured by Tosoh Corporation as a measuring device, TSKgel SuperHM-M (15 cm), a column manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

A known preparing method is applied to prepare the polyester resin. Specific examples thereof include a method of conducting a reaction at a polymerization temperature set to 180° C. to 230° C., if necessary, under reduced pressure in the reaction system, while removing water or an alcohol generated during condensation.

In the case in which monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In the case in which a monomer having poor compatibility is present in a copolymerization reaction, the monomer having poor compatibility and an acid or an alcohol to be polycondensed with the monomer may be previously condensed and then polycondensed with the main component.

The content of the binder resin is, for example, preferably from 40% by weight to 95% by weight, more preferably from 50% by weight to 90% by weight, and even more preferably from 60% by weight to 85% by weight with respect to a total amount of toner particles.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 38, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

As the colorant, the surface-treated colorant may be used, if necessary. The colorant may be used in combination with a dispersing agent. Plural colorants may be used in combination.

The content of the colorant is preferably from 1 to 30% by weight, more preferably from 3 to 15% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C. and more preferably from 60° C. to 100° C.

The melting temperature is obtained from "melting peak temperature" described in the method of obtaining a melting temperature in JIS K 1721-1987 "Testing Methods for Transition Temperatures of Plastics", from a DSC curve obtained by differential scanning calorimetry (DSC).

The content of the release agent is, for example, preferably from 1% by weight to 20% by weight, and more preferably from 5% by weight to 15% by weight with respect to the total toner particles.

Other Additives

Examples of other additives include known additives such as a magnetic material, a charge-controlling agent, and an inorganic powder. The toner particles include these additives as internal additives.

Characteristics of Toner Particles

The toner particles may be toner particles having a single-layer structure, or toner particles having a so-called core/shell structure composed of a core part (core particle) and a coating layer (shell layer) coated on the core part.

Here, toner particles having a core/shell structure is preferably composed of, for example, a core part containing a binder resin, and if necessary, other additives such as a colorant and a release agent and a coating layer containing a binder resin.

The volume average particle diameter ($D_{50v}$) of the toner particles is preferably from 2 μm to 10 μm, and more preferably from 4 μm to 8 μm.

Various average particle diameters and various particle size distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter $D_{16v}$ and a number average particle diameter $D_{16p}$, while the particle diameter when the cumulative percentage becomes 50% is defined as that corresponding to a volume average particle diameter $D_{50v}$ and a number average particle diameter $D_{50p}$. Furthermore, the particle diameter when the cumulative percentage becomes 84% is defined as that corresponding to a volume average particle diameter $D_{84v}$ and a number average particle diameter $D_{84p}$.

Using these, a volume average particle size distribution index (GSDv) is calculated as $(D_{84v}/D_{16v})^{1/2}$, while a number average particle size distribution index (GSDp) is calculated as $(D_{84p}/D_{16p})^{1/2}$.

The average circularity of the toner particles is preferably from 0.88 to 0.99 and more preferably from 0.90 to 0.97.

The average circularity of the toner is measured by FPIA-3000 manufactured by Sysmex Corporation. In this apparatus, a method of performing the measurement of particles dispersed in water or the like by a flow type image analysis method is used, and a suctioned particle suspension is introduced to a flat sheath flow cell and a flat sample flow is formed by sheath liquid. The particles being passed are imaged as a still image with a CCD camera through an object lens by irradiating the sample flow with stroboscopic light. The captured particle image is subjected to two-dimensional image treatment and circularity is calculated from a projected area and a circumference length. Regarding the circularity, image analysis is performed with respect to each of at least 4,000 samples and an average circularity is determined by statistical processing.

Expression: circularity=equivalent circle diameter circumference length/circumference length=$[2\times(A\pi)^{1/2}]/PM$ In the expression, A represents a projected area and PM represents a circumference length. In the measurement HPF mode (high resolution mode) is used and a dilution rate is set as 1.0 times.

External Additive

Examples of the external additive include inorganic particles. Examples of the inorganic particles include $SiO_2$, $TiO_2$, $Al_2O_3$, CuO, ZnO, SnOz, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles used as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate (PMMA), and melamine resin) and a cleaning aid (for example, a metal salt of higher fatty acid represented by zinc stearate, and fluorine polymer particles).

The amount of the external additive externally added is, for example, preferably from 0.01% by weight to 7% by weight and more preferably from 0.1% by weight to 5% by weight, with respect to the toner particles.

Toner Preparing Method

Next, a method of preparing the toner according to the exemplary embodiment will be described.

The toner according to the exemplary embodiment is obtained by externally adding an external additive, if necessary, to toner particles, after preparing the toner particles. Specifically, the toner is obtained by preparing each of the colored toner particles and the transparent toner particles, externally adding an external additive, if necessary, to toner particles, and mixing each of the toner particles after the external addition. In addition, the toner may be obtained by mixing each of the toner particles and externally adding an external additive, if necessary, to the toner particles after the mixing.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

Among these, the toner particles may be obtained by the aggregation and coalescence method.

Specifically, for example, when the toner particles are manufactured by an aggregation and coalescence method, the toner particles are manufactured through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the processes will be described below in detail.

In the following description, a method of obtaining toner particles containing a colorant and a release agent will be described, but a colorant and a release agent are used, if necessary. Other additives may be used, in addition to a colorant and a release agent.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Herein, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO MILL having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, manufactured by Horiba, Ltd., LA-700), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent particle dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is from 2 to 5). If necessary, a dispersion stabilizer is added. Then, the mixed dispersion is heated at a temperature of approximately the glass transition temperature of the resin particles (specifically, for example, from a temperature 20° C. lower than the glass transition temperature of the resin particles to the glass transition temperature) to aggregate the particles dispersed in the mixed dispersion, thereby forming the aggregated particles.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 parts by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

Toner particles may be prepared through the processes of: after the aggregated particle dispersion in which the aggregated particles are dispersed is obtained, further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

Then, the toner according to the exemplary embodiment may be prepared by adding an external additive to the obtained dry toner particles and mixing the materials. The mixing may be performed by using a V blender, a HENSCHEL mixer, a LÖDIGE mixer, and the like. Further, if necessary, coarse toner particles may be removed by using a vibration classifier, a wind classifier, and the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive particle.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on the charged surface of the image holding member, a developing unit that accommodates an electrostatic charge image developer and develops the electrostatic charge image formed on the surface of the image holding member with the electrostatic charge image developer as a toner image, a transfer unit that transfers the toner image formed on the surface of the image holding member to a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including the steps of: charging a surface of an image holding member; forming an electrostatic charge image on the charged surface of the image holding member; developing the electrostatic charge image formed on the surface of the image holding member with the electrostatic charge image developer according to this exemplary embodiment as a toner image; transferring the toner image formed on the surface of the image holding member to a surface of a recording medium; and fixing the toner image transferred onto the surface of the recording medium is performed.

As the image forming apparatus according to this exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that is provided with a developing unit that accommodates the electrostatic charge image developer according to this exemplary embodiment is suitably used.

Hereinafter, an example of the image forming apparatus according to this exemplary embodiment will be shown. However, the image forming apparatus is not limited thereto. Main portions shown in the drawing will be described, but descriptions of other portions will be omitted.

FIG. 1 is a schematic diagram showing a configuration of the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 11C, and 10K are arranged side by side at predetermined intervals in a horizontal direction.

These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges BY, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10CY will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general, resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being agitated in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations ends.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. Major parts shown in the drawing will be described, but descriptions of other parts will be omitted.

Figure 2:
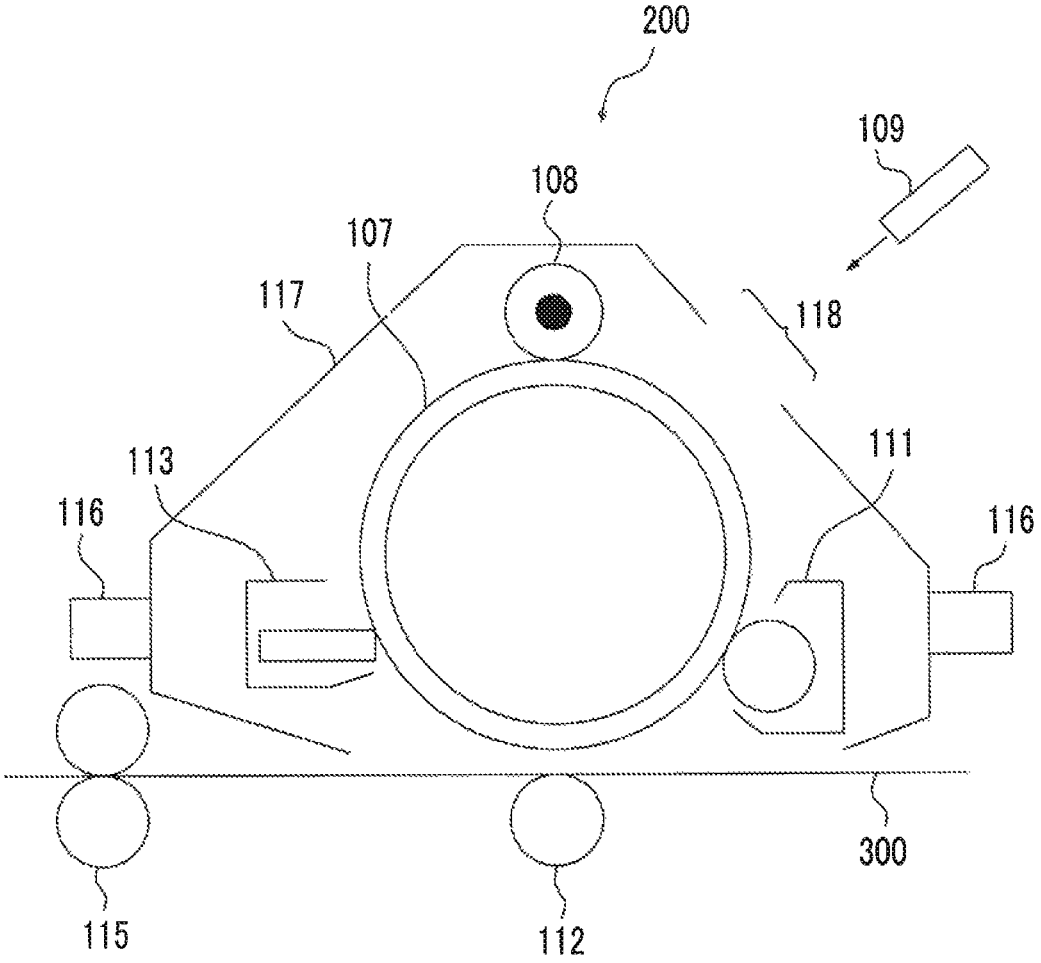
FIG. 2 is a schematic configuration diagram showing an example of a process cartridge according to the exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus. The toner cartridge may include a container which contains the toner according to this exemplary embodiment.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

Hereinafter, the exemplary embodiment will be described in detail using examples but the exemplary embodiment is not limited to the examples. In the following description, "parts" and "%" are based on weight, unless otherwise noted.

Preparation of Toner Particles

Preparation of Toner Particles (A)

Preparation of Polyester Resin Particle Dispersion (1)

120.0 parts of 1,10-decanediol, 80.0 parts of dimethyl isophthalate, 4 parts of dimethyl sulfoxide, and 0.02 parts of dibutyl tin oxide as a catalyst are added in a heated and dried three-necked flask, air in the vessel is turned into an inert atmosphere with nitrogen gas by performing pressure reducing operation, and the mixture is stirred by mechanical stirring at 180° C. for 3 hours. Dimethyl sulfoxide is distilled away under the reduced pressure and 23.0 parts of dimethyl dodecanedioate is added thereto under the nitrogen atmosphere, and the mixture is stirred at 180° C. for 1 hour. After that, the temperature is slowly increased to 220° C. under the reduced pressure, the mixture is stirred for 30 minutes and, at the time when a viscous state is obtained, air cooling is performed to stop the reaction, thereby obtaining a polyester resin (1).

A weight average molecular weight (Mw) of the obtained polyester resin (1) is 20,000, in the molecular weight measurement (polystyrene conversion) by gel permeation chromatography. A glass transition temperature of the polyester resin (1) is 75° C.

Next, the polyester resin (1) is coarsely pulverized with a hammer mill. 50 parts of ethyl acetate and 110 parts of isopropyl alcohol (IPA) are added into a 2 L separable flask equipped with an anchor blade for applying stirring power, a refluxing device, and a decompression device by a vacuum pump, $N_2$ is supplied at a rate of 0.2 L/m and air in the system is substituted with $N_2$. Then, 200 parts of the coarsely pulverized polyester resin (1) is slowly added thereto, stirred, and dissolved, while increasing the temperature to 60° C. by an oil bath device in the system. Next, after adding 20 parts of 10% ammonia water thereto, 460 parts of ion exchange water is added thereto while stirring using a constant rate pump at a rate of 9.6 g/m. It is regarded that emulsification is completed at the time when the inside of an emulsification system exhibits milky white and viscosity on stirring is decreased.

Next, the pressure is reduced to −700 Torr and the resultant emulsion is stirred for 40 minutes. 50 parts of pure water at 60° C. is further added thereto and stirring is continued for 20 minutes under the reduced pressure. When refluxing amount reaches 210 parts, that point is set as a finish point, the heating is stopped, the mixture is cooled to room temperature (24° C.) while stirring, ion exchange water is added to provide a solid content of 25%, and thus, a polyester resin particle dispersion (1) is obtained. When a particle diameter of the obtained polyester resin particles is measured using a laser scattering particle distribution analyzer (LA-920 manufactured by Horiba, Ltd.), a volume average particle diameter of the obtained polyester resin particles is 202 nm.

Preparation of Polyester Resin Particle Dispersion (2)

112 parts of dimethyl naphthalenedicarboxylate, 97 parts of dimethyl terephthalate, 221 parts of bisphenol A ethylene oxide (EO) adduct, 80 parts of ethylene glycol, and 0.07 parts of tetrabutoxytitanate are added in a heated and dried three-necked flask, heated at 170° C. to 220° C. for 180 minutes, and subjected to transesterification. Then, the reaction is continued for 60 minutes by setting the pressure of the system at 220° C. as 1 mmHg to 10 mmHg and thus, a polyester resin (2) is obtained. A glass transition temperature of the polyester resin (2) is 65° C.

Then, the polyester resin (2) is coarsely pulverized with a hammer mill. 75 parts of ethyl acetate and 160 parts of isopropyl alcohol (IPA) are added into a 2 L separable flask equipped with an anchor blade for applying stirring power, a refluxing device, and a decompression device by a vacuum pump, $N_2$ is supplied at a rate of 0.2 L/m and air in the system is substituted with $N_2$. Then, 200 parts of the coarsely pulverized amorphous polyester resin (2) is slowly added thereto, stirred, and dissolved, while increasing the temperature to 60° C. by an oil bath device in the system. Next, after adding 20 parts of 10% ammonia water thereto, 460 parts of ion exchange water is added thereto while stirring using a constant rate pump at a rate of 9.6 g/m. It is regarded that emulsification is completed at the time when the inside of an emulsification system exhibits milky white and viscosity on stirring is decreased.

Next, the pressure is reduced to −700 Torr and the resultant emulsion is stirred for 40 minutes. 50 parts of pure water at 60° C. is further added thereto and stirring is continued for 20 minutes under the reduced pressure. When refluxing amount reaches 210 parts, that point is set as a finish point, the heating is stopped, the mixture is cooled to room temperature (20° C.) while stirring, ion exchange water is added to provide a solid content of 25%, and thus, a polyester resin particle dispersion (2) is obtained. When a particle diameter of the obtained polyester resin particles is measured using a laser diffraction-type particle size distribution measuring device (LA-920 manufactured by Horiba, Ltd.), a volume average particle diameter of the obtained polyester resin particles is 151 nm.

Preparation of Colorant Particle Dispersion (1)

| | |
|---|---|
| Carbon black R330 (manufactured by Cabot Corporation): | 30 parts |
| Anionic surfactant NEW REX R (manufactured by NOF CORPORATION): | 2 parts |
| Ion exchange water: | 220 parts |

The above components are mixed with each other and preliminarily dispersed using a homogenizer (ULTRA TURRAX manufactured by IKA Works, Inc.) for 10 minutes, a dispersion process is performed using an ultimizer (counter collision type wet pulverizer: manufactured by SUGINO MACHINE LIMITED) at pressure of 245 mPa for 15 minutes, and thus, a colorant particle dispersion (1) having a median diameter of 333 nm and a solid content of 20% is obtained.

Preparation of Colorant Particle Dispersion (2)

| | |
|---|---|
| C.I. Pigment Red 269 (SYMULER FAST RED 1022 manufactured by DIC Corporation): | 200 parts |
| Anionic surfactant (NEOGEN SC manufactured by DKS Co., Ltd.): (60% of active ingredient, 10% with respect to the colorant) | 33 parts |
| Ion exchange water: | 750 parts |

280 parts of ion exchange water and 33 parts of anionic surfactant are put in a stainless steel vessel having a size that a height of a liquid surface when all of the above components are put therein is approximately ⅓ of the height of the vessel, the surfactant is sufficiently dissolved, the above pigment all is put therein, the resultant material is stirred using a stirrer until all the unwet pigments disappear and such that sufficient defoaming is performed. The remaining ion exchange water is added thereto after the defoaming, the obtained mixture is dispersed by using a homogenizer (ULTRA TURRAX T50 manufactured by IKA Japan, K.K.) with 5,000 rpm for 10 minutes, is stirred using the stirrer for 24 hours and defoamed. After the defoaming, the resultant material is dispersed again by using the homogenizer with 6,000 rpm for 10 minutes, is stirred and defoamed using the stirrer for 24 hours. Then, the dispersion is dispersed by using a high pressure impact type dispersing machine ULTIMIZER (HJP30006 manufactured by SUGINO MACHINE LIMITED) at a pressure of 240 MPa. About 25 passes of the dispersion are performed, taking into account the conversion from the total introduction amount and processing capacity of the device. The obtained dispersion is allowed to stand for 72 hours to remove precipitates, and ion exchange water is added thereto to adjust a solid content concentration to 15%. The volume average particle size 050 of particles in the resultant magenta pigment dispersion 1 is 135 nm. The volume average particle size D50 is an average value of three measurement values excluding the maximum value and the minimum value, when measurement is performed five times using a microtrack.

Preparation of Colorant Particle Dispersion (3)

A yellow pigment dispersion is prepared by the same method as in the preparation of the colorant particle dispersion (2), except for changing the magenta pigment to C.I. Pigment Yellow 185 (PALIOTOL YELLOW D1155 manufactured by BASF).

The volume average particle size D50 of particles in the yellow pigment dispersion is 170 nm.

Preparation of Colorant Particle Dispersion (4)

A cyan pigment dispersion is prepared by the same method as in the preparation of the colorant particle dispersion (2), except for changing the magenta pigment to C.I. Pigment Blue 15:3 (HELIOGEN BLUE D7092 manufactured by BASF).

The volume average particle size D50 of particles in the cyan pigment dispersion is 130 nm.

Preparation of Release Agent Particle Dispersion (1)

| | |
|---|---|
| Paraffin Wax FNP92 (melting temperature of 91° C., manufactured by Nippon Seiro Co., Ltd.): | 80 parts |
| Cationic surfactant NEOGEN RK (manufactured by DES Co., Ltd.): | 5 parts |
| Ion exchange water: | 200 parts |

The above components are heated to 75° C. and dispersed using ULTRA TURRAX T50 manufactured by IKA Works, Inc., and the resultant is subjected to a dispersion process performed by using a PRESSURE DISCHARGE TYPE GAULIN HOMOGENIZER, thereby obtain a wax dispersion having a median diameter of 170 nm and a solid content of 25%.

Preparation of Toner Particles (A)

| | |
|---|---|
| Polyester resin particle dispersion (1): | 49 parts |
| Polyester resin particle dispersion (2): | 155 parts |
| Colorant particle dispersion (1): | 50 parts |
| Release agent particle dispersion (1): | 36 parts |
| Polyaluminum chloride: | 1.6 parts |

291.6 g of the above components are mixed and dispersed in a round stainless steel flask using a homogenizer (ULTRA TURRAX T50 manufactured by IKA Works, Inc.), heated to 46° C. while stirring the components in the flask in a heating oil bath, and held at 46° C. for 60 minutes, to prepare an aggregated particle dispersion. Then, after further adding 120 parts of the polyester resin particle dispersion (2) thereto, holding the mixture for 30 minutes, and adjusting the pH in the system to 5.4 by adding 0.5 mol/liter of sodium hydroxide aqueous solution, the mixture is heated to 96° C. while continuing stirring and kept for 5 hours. After the reaction ends, the mixture is cooled and filtered, and solid-liquid separation is performed by Nutsche-type suction filtration. In addition, the solid content is dispersed again in 3 liters of ion exchange water at 40° C., the solid-liquid separation is performed after stirring at 450 rpm for 15 minutes, and this operation is further repeated five times. Then, vacuum drying is continued for 12 hours and thus, toner particles (A) are obtained.

The volume average particle diameter of the toner particles (A) is 6.1 μm, the volume average particle size distribution is 1.25, and the average circularity is 0.964.

Preparation of Toner Particles (B) to (K)

Toner particles (B) to (K) are obtained in the same manner as in the preparation of toner particles (A), except for changing the amount of each dispersion to the amount shown in Tables 1 and 2.

Examples 1 to 6 and Comparative Examples 1 to 6

Preparation of Toner

Two kinds of first and second toner particles are mixed with each other with the combination and weight ratio (combination amount) according to Table 3 and Table 4. 100 parts of the mixed toner particles and 1.5 parts of hydrophobic silica (TS720 Cabot Corporation) are mixed using a HENSCHEL MIXER at a circumferential speed of 20 m/sec for 15 minutes, coarse particles are removed using a sieve having an aperture of 45 μm, and toners of Examples 1 to 6 and Comparative Examples 1 to 6 are obtained. Herein, in each of Example 6 and Comparative Example 6, four colored toners of a yellow toner, a magenta toner, a cyan toner, and a black toner are obtained.

In Table 3 and Table 4, the "total colorant content" indicates the total content (with respect to the total amount of toner particles including the first toner particles and the second toner particles) of the colorant of the two kinds of first and second toner particles.

Preparation of Carrier

| | |
|---|---|
| Ferrite particles (volume average particle diameter of 50 μm): | 100 parts |
| Toluene: | 14 parts |
| A styrene-methyl methacrylate copolymer: (component ratio: 90/10, Mw = 80,000) | 2 parts |
| Carbon black (VXC-72 manufactured by Cabot Corporation): | 0.2 parts |

First, the above components excluding the ferrite particles are stirred by a stirrer for 10 minutes to obtain a dispersed coating solution, and the coating solution and the ferrite particles are put into a vacuum degassing type kneader, stirred at 60° C. for 30 minutes, degassed under the reduced pressure while heating, and dried to obtain a carrier.

Preparation of Developer 8 parts of each of the obtained toner and 100 parts of carrier are mixed while stirring using a V blender at 20 rpm for 20 minutes, and sieved using a sieve having an aperture of 212 μm, to obtain developers of Examples 1 to 6 and Comparative Examples 1 to 6.

Evaluation

Regarding the developer in each example, in a developing device of an image forming apparatus "DOCUPRINT CP400d (manufactured by Fuji Xerox Co., Ltd.)", only a developing device for black is filled with the developers of Examples 1 to 5 and Comparative Examples 1 to 5 and developing devices for four colors are filled with the developers of Example 6 and Comparative Example 6. Using this image forming apparatus, a test chart No1R of The Imaging Society of Japan is printed on rough paper "PREMIER80" (manufactured by Fuji Xerox Co., Ltd., A4-sized, basis weight of 80 gsm, smoothness: 17 seconds". However, in the apparatus using the developers of Examples 1 to 5 and Comparative Examples 1 to 5, the printing is performed in a monochrome mode and the following evaluation is performed regarding primary colored image. In the apparatus using the developers of Example 6 and Comparative Example 6, the printing is performed in a full-color mode, and the following evaluation is performed regarding primary and tertiary colored (mixed color of cyan, magenta, yellow) image.

Resolution of Image

The resolution of the image is evaluated using the printed test chart. Specifically, the "smallest alphabet and thin line" of the test chart are visually observed and collapse, loss of definition, and thickening of the thin line and characters are evaluated with the following evaluation criteria.

Evaluation Criteria of Resolution

A: excellent state with no collapse, loss of definition, and thickening of the thin line and characters B: slight collapse, loss of definition, and thickening of the thin line and characters are observed, but in a level having no problem for reading C: some collapse, loss of definition, and thickening of the thin line and characters are observed, but in a level in which images may be read D: collapse, loss of definition, and thickening of the thin line and characters are observed, and in a level with problems in use.

Image Density

Image density is evaluated using the printed test chart. Specifically, the density of the test chart "solid portion" is measured using image densitometer X-RITE 938 (manufactured by X-Rite, Inc.), and evaluation is performed based on the following evaluation criteria.

Evaluation Criteria of Density

A: image density is from 1.4 to 1.6 (excellent image density)

B: image density is equal to or greater than 1.2 and smaller than 1.4 or exceeds 1.6 and equal to or smaller than 1.7 (level with no problems in use)

C: image density is equal to or greater than 1.0 and smaller than 1.2 or exceeds 1.7 and equal to or smaller than 1.8 (image density is slightly high or low, but acceptable level)

D: image density is smaller than 1.0 or exceeds 1.8 (image density is too high or low and in a level with problems in use)

TABLE 1

| | Toner particles (A) | Toner particles (B) | Toner particles (C) | Toner particles (D) | Toner particles (E) | Toner particles (F) |
|---|---|---|---|---|---|---|
| Amount of polyester resin particle dispersion (1) | 49 parts | 53 parts | 53 parts | 55 parts | 46 parts | 40 parts |
| Amount of polyester resin particle dispersion (2) | 155 parts | 179 parts | 183 parts | 189 parts | 138 parts | 104 parts |
| Kind and amount of colorant particle dispersion | Colorant particle dispersion (1) 50 parts | Colorant particle dispersion (1) 15 parts | Colorant particle dispersion (1) 10 parts | Colorant particle dispersion (1) 0 parts | Colorant particle dispersion (1) 75 parts | Colorant particle dispersion (1) 125 parts |
| Release agent particle dispersion (1) | 36 parts | 36 parts | 36 parts | 36 parts | 36 parts | 36 parts |
| Polyaluminum chloride | 1.6 parts | 1.6 parts | 1.6 parts | 1.6 parts | 1.6 parts | 1.6 parts |
| Amount of further added polyester resin particle dispersion (2) | 120 parts | 120 parts | 120 parts | 120 parts | 120 parts | 120 parts |
| Color | Black | Black | Black | Clear | Black | Black |
| Colorant content (with respect to toner particles) | 10% by weight | 3% by weight | 2% by weight | 0% by weight | 15% by weight | 25% by weight |

TABLE 2

| | Toner particles (G) | Toner particles (H) | Toner particles (I) | Toner particles (J) | Toner particles (K) |
|---|---|---|---|---|---|
| Amount of polyester resin particle dispersion (1) | 50 parts | 46 parts | 52 parts | 43 parts | 51 parts |
| Amount of polyester resin particle dispersion (2) | 162 parts | 142 parts | 176 parts | 121 parts | 169 parts |
| Kind and amount of colorant particle dispersion | Colorant particle dispersion (3) 53 parts | Colorant particle dispersion (2) 93 parts | Colorant particle dispersion (2) 27 parts | Colorant particle dispersion (4) 133 parts | Colorant particle dispersion (4) 40 parts |
| Release agent particle dispersion (1) | 36 parts | 36 parts | 36 parts | 36 parts | 36 parts |
| Polyaluminum chloride | 1.6 parts | 1.6 parts | 1.6 parts | 1.6 parts | 1.6 parts |
| Amount of further added polyester resin particle dispersion (2) | 120 parts | 120 parts | 120 parts | 120 parts | 120 parts |
| Color | Yellow | Magenta | Magenta | Cyan | Cyan |
| Colorant content (with respect to toner particles) | 8% by weight | 14% by weight | 4% by weight | 20% by weight | 6% by weight |

TABLE 3

| | First toner particles | | | Second toner particles | | | | | Evaluation | |
|---|---|---|---|---|---|---|---|---|---|---|
| | Kind | Color | Colorant content | Kind | Color | Colorant content | Weight ratio (first/second) | Total colorant content | Image density | Image resolution |
| Example 1 | Toner particles (A) | Black | 10% | Toner particles (D) | Clear | 0% | 70/30 | 7 | A | A |
| Example 2 | Toner particles (A) | Black | 10% | Toner particles (D) | Clear | 0% | 50/50 | 5 | B | A |
| Example 3 | Toner particles (A) | Black | 10% | Toner particles (C) | Black | 2% | 98/2 | 9.8 | A | C |
| Example 4 | Toner particles (E) | Black | 15% | Toner particles (D) | Clear | 0% | 95/5 | 14.3 | B | B |
| Example 5 | Toner particles (E) | Black | 15% | Toner particles (D) | Clear | 0% | 50/50 | 7.5 | A | B |
| Comparative Example 1 | Toner particles (A) | Black | 10% | Toner particles (D) | Clear | 0% | 40/60 | 4 | D | B |
| Comparative Example 2 | Toner particles (A) | Black | 10% | Toner particles (C) | Black | 2% | 99/1 | 9.92 | A | D |
| Comparative Example 3 | Toner particles (F) | Black | 25% | Toner particles (D) | Clear | 0% | 70/30 | 17.5 | B | D |

TABLE 3-continued

| | First toner particles | | | Second toner particles | | | | | Evaluation | |
|---|---|---|---|---|---|---|---|---|---|---|
| | Kind | Color | Colorant content | Kind | Color | Colorant content | Weight ratio (first/second) | Total colorant content | Image density | Image resolution |
| Comparative Example 4 | Toner particles (B) | Black | 3% | Toner particles (C) | Black | 2% | 70/30 | 2.7 | D | D |
| Comparative Example 5 | Toner particles (A) | Black | 10% | Toner particles (B) | Black | 3% | 95/5 | 9.7 | A | D |

TABLE 4

| | First toner particles | | | Second toner particles | | | | Total | Evaluation | | | |
|---|---|---|---|---|---|---|---|---|---|---|---|---|
| | | | | | | | | | Image density | | Image resolution | |
| | Kind | Color | Colorant content | Kind | Color | Colorant content | Weight ratio (first/second) | colorant content | Primary color | Tertiary color | Primary color | Tertiary color |
| Example 6 | Toner particles (G) | Yellow | 8% | Toner particles (D) | Clear | 0% | 60/40 | 4.8 | B | A | B | A |
| | Toner particles (H) | Magenta | 14% | Toner particles (D) | Clear | 0% | 60/40 | 8.4 | A | | A | |
| | Toner particles (J) | Cyan | 20% | Toner particles (D) | Clear | 0% | 60/40 | 12 | B | | B | |
| | Toner particles (A) | Black | 10% | Toner particles (D) | Clear | 0% | 80/20 | 8 | A | | A | |
| Comparative Example 6 | Toner particles (G) | Yellow | 8% | Toner particles (D) | Clear | 0% | 40/60 | 3.2 | D | B | D | D |
| | Toner particles (H) | Magenta | 14% | Toner particles (I) | Magenta | 4% | 50/50 | 9 | A | | D | |
| | Toner particles (K) | Cyan | 6% | Toner particles (D) | Clear | 0% | 50/50 | 3 | D | | C | |
| | Toner particles (E) | Biack | 15% | Toner particles (D) | Clear | 0% | 99/1 | 14.9 | C | | D | |

From the above results, it is found that, in the examples, a decrease in resolution of a fine image is prevented, compared to comparative examples.

In addition, it is found that density of a fine image is obtained in the examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A mixed electrostatic charge image developing toner comprising:

first toner particles comprising a binder resin and a colorant, and second toner particles comprising a binder resin, wherein a content PCa of the colorant in the first toner particles is from 4% by weight to 20% by weight with respect to the first toner particles a mixed weight ratio of the first toner particles and the second toner particles (weight of the first toner particles/weight of the second toner particles) is from 50/50 to 98/2, an average circularity of the toner particles in at least one of the first or second toner particles is in a range of from 0.88 to 0.99, and the second toner particles do not contain a colorant.

2. The electrostatic charge image developing toner according to claim 1, wherein a total content of the colorant of the first toner particles is from 4% by weight to 15% by weight with respect to a total amount of toner particles including the first toner particles and the second toner particles.

3. The electrostatic charge image developing toner according to claim 1, wherein the weight ratio of the first toner particles and the second toner particles (weight of the first toner particles/weight of the second toner particles) is from 50/50 to 95/5.

4. The electrostatic charge image developing toner according to claim 1, wherein the binder resin in the first toner particles and the binder resin in the second toner particles each independently comprises a polyester resin having a glass transition temperature (Tg) of from 50° C. to 80° C.

5. The electrostatic charge image developing toner according to claim 1, wherein the binder resin in the first toner particles and the binder resin in the second toner particles each independently comprises a polyester resin having a weight average molecular weight (Mw) of from 7,000 to 500,000.

6. The electrostatic charge image developing toner according to claim 1, wherein the first toner particles, the second toner particles, or both comprise a release agent having a melting temperature of from 60° C. to 100° C.

7. An electrostatic charge image developer comprising the electrostatic charge image developing toner according to claim 1.

8. A toner cartridge comprising:

a container that contains the electrostatic charge image developing toner according to claim 1, wherein the toner cartridge is detachable from an image forming apparatus.

9. The electrostatic charge image developing toner according to claim 1, wherein at least one of the binder resins of the first or second toner particles comprises a polyester resin with a molecular weight distribution Mw/Mn in a range of from 1.5 to 100.

* * * * *